United States Patent [19]

Poganitsch et al.

[11] Patent Number: 4,891,880

[45] Date of Patent: Jan. 9, 1990

[54] DRY-SHAVING APPARATUS COMPRISING AT LEAST ONE SLIDABLE SHUTTER

[75] Inventors: Ernst Poganitsch; Arno Wolfger, Klagenfurt, both of Austria

[73] Assignee: U. S. Philips Corp., New York, N.Y.

[21] Appl. No.: 184,314

[22] Filed: Apr. 21, 1988

[30] Foreign Application Priority Data

Apr. 24, 1987 [AT] Austria ..... 1027/87

[51] Int. Cl.[4] ..... D26B 19/04

[52] U.S. Cl. ..... 30/34.05; 30/43.92

[58] Field of Search ..... 30/32, 34 R, 43, 43.91, 30/43.92, 90

[56] References Cited

FOREIGN PATENT DOCUMENTS 1122410 1/1962 Fed. Rep. of Germany ..... 30/34 R
2750795 11/1977 Fed. Rep. of Germany .
3415121 10/1985 Fed. Rep. of Germany .

*Primary Examiner*—Douglas D. Watts
*Attorney, Agent, or Firm*—Ernestine C. Bartlett

[57] ABSTRACT

A dry-shaving apparatus is provided comprising a shaving-head frame (2), which can be placed on a basic apparatus (1), which carries a shear foil (7), and which is detachably secured to the basic apparatus by means of at least one resilient latch (12), and at least one slidable shutter (3) for optionally covering or exposing the shear foil wherein the shutter is movable from a position on the basic apparatus in which it exposes the shaving-head frame and the shear foil to a position on the shaving-head frame, and wherein movement of the latch to detach the shaving-head frame from the basic apparatus is blocked by the shutter when the shutter has been moved at least partly out of the position in which it exposes the shaving-head frame and the shear foil.

6 Claims, 3 Drawing Sheets

DRY-SHAVING APPARATUS COMPRISING AT LEAST ONE SLIDABLE SHUTTER

BACKGROUND OF THE INVENTION

The invention relates to a dry-shaving apparatus comprising at least one slidable shutter for optionally covering or exposing a shear foil of the dry-shaving apparatus. Such a dry-shaving apparatus is known from DE-AS No. 11 22 410.

SUMMARY OF THE INVENTION

It is the object of the invention to construct a dry-shaving apparatus comprising at least one slidable shutter for optionally covering or exposing a shear foil of the apparatus in such a way that it is very convenient to operate and so as to preclude incorrect operation. To this end, according to the invention, in a dry-shaving apparatus comprising a shaving-head frame which carries the shear foil and which is detachably secured to a basic apparatus by means of at least one resilient latch, the shutter is slidable from a position on the basic apparatus in which it exposes the shaving-head frame and the shear foil to a position onto the shaving-head frame and the shear foil. When in the position in which it at least partly covers the shear foil, the shutter prevents the latch from being moved in order to detach the shaving-head frame from the basic apparatus.

Dry-shaving apparatus comprising a shaving-head frame which carries the shear foil and which is detachably secured to the basic apparatus by means of at least one resilient latch provide the user with a simple possibility to effect cleaning or to replace the shear foil after removal of the shaving-head frame from the basic apparatus. Such dry-shaving apparatus are generally known per se, for example from DE-OS No. 27 50 795. Such a dry-shaving apparatus is now equipped, according to this invention with a shutter which is slidable from a position on the basic apparatus in which the shaving-head frame and the shear foil are exposed to a position onto the shaving-head frame and the shear foil in which the frame and foil are covered, care being taken that the shaving-head frame can be removed from the basic apparatus only if the shutter does not cover the shaving-head frame and the shear foil. This is achieved in that the shutter, when it is not in a position in which it covers the shaving-head frame and the shear foil, directly prevents a latch from being moved to detach the shaving-head frame from the basic apparatus. This precludes incorrect operation and consequent damage to the shutter, the shaving-head frame or the shear foil.

Preferably in a dry-shaving apparatus in which the shaving-head frame is detached from the basic apparatus by a latch movable by means of an actuating element, the shutter, when slid at least partly out of the position in which it exposes the shaving-head frame and the shear foil, prevents the actuating element from being actuated and thereby prevents movement of the latch for detaching the shaving-head frame from the basic apparatus. It is to be noted that dry-shaving apparatus in which a latch for detaching the shaving-head frame from the basic apparatus is movable by means of an actuating element which is arranged, for example, on the basic apparatus, are known per se, as is disclosed in, for example, DOS No. 15 53 752, but this is not in conjunction with a shutter for optionally covering or exposing a shear foil mounted in a shaving-head frame.

In a preferred embodiment, the shutter comprises an elastic carrier and spaced-apart slats and is guided laterally at both sides in groove-shaped guides on the dry-shaving apparatus, as known from the afore-mentioned DE-AS No. 11 22 410. Preferably also, a resilient latch arranged on a side wall of the basic apparatus secures the shaving-head frame by at least one of its two side walls and is movable by an actuating element provided on the side wall of the shaving-head frame. The actuating element moves the latch to detach the shaving-head frame from the basic apparatus and is constructed as an additional side wall of the shaving-head frame, which additional side wall extends parallel to and is situated at the outer side of the side wall of the shaving-head frame. Preferably, lateral guide means for the shutter are located on the shaving-head frame in at least one of the two parallel side walls of the shaving-head frame, the shutter extends over the inner side wall of the shaving-head frame, and the ends of the inherently stiff slats, which slats extend across the full width of the shutter, are provided with stiff lateral projections which engage in said guide means. In this way the inherently stiff shutter slats engage in the lateral guide means for the shutter, and prevent the actuating element from being actuated to detach the shaving-head frame from the basic apparatus, so that the shaving-head frame cannot be removed from the basic apparatus if the shutter has been moved towards the shaving-head frame and the shear foil. It is to be noted that dry-shaving apparatus in which the shaving head frame is secured by at least one of its two side walls with the aid of a resilient latch arranged on a side wall of the basic apparatus and in which the latching element for detaching the shaving-head frame from the basic apparatus is movable by means of an actuating element arranged on the side wall of the shaving-head frame are known per se, as is disclosed for example, in DE-OS No. 34 15 121, but not in combination with a shutter for optionally covering or exposing a shear foil mounted in a shaving-head frame.

It is also preferred that the projections of the slats of the shutter be L-shaped and project from the slats transversely of the shutter, extending in a gap formed at the location of the shaving-head frame between the inner side wall and the outer side wall and engaging in the guide means with their free ends. When thus constructed, the slat projections provide a satisfactory shutter guidance which does not require the height of the outer side wall of the shaving-head frame to be extended substantially beyond the shear foil. Such an L-shaped construction of the projections of the shutter slats ensures that the outer side wall of the shaving-head frame constituting the actuating element for moving the latch to detach the shaving-head frame from the basic apparatus cannot be actuated, because the inner side wall constitutes an abutment for the L-shaped projection when the shutter is positioned at the location of the shaving-head frame and it is attempted to actuate the actuating element in order to move the latch.

In this respect it is further preferred that the lateral guide means for the shutter be provided on the shaving-head frame comprising a peripheral angular portion situated on the outer side wall, and directed towards the inner side wall, and a peripheral offset portion situated on the inner side wall and directed towards the outer side wall, which portions are spaced from each other, the L-shaped projections of the slats of the shutter engaging in the gap between the angular portion and the offset portion. This results in a simple construction of the guide means for the shutter and it ensures in a very reliable manner that the outer side wall constituting the actuating element for moving the latch to release the shaving-head frame from the basic apparatus cannot be actuated when the shutter is situated at the location of the shaving-head frame.

In this respect it is also very advantageous if the outer side wall constituting the actuating element for moving the latch is pivotably arranged on the inner side wall of the shaving-head frame, the pivotal axis being situated in the area of the shaving-head frame which is remote from the basic apparatus. Such a pivotal construction of the outer side wall of the shaving-head frame ensures that this wall can be actuated only at its end which faces the basic apparatus in order to move the latch, thus also ensuring that it can be actuated only if the shutter has completely exposed the shavig-head frame and the shear foil.

BRIEF DESCRIPTION OF THE DRAWINGS

Embodiments of the invention will now be described in more detail, by way of example, with reference to the accompanying drawings.

DETAILED DESCRIPTION OF THE PREFERRED EMBODIMENTS

Figure 1:
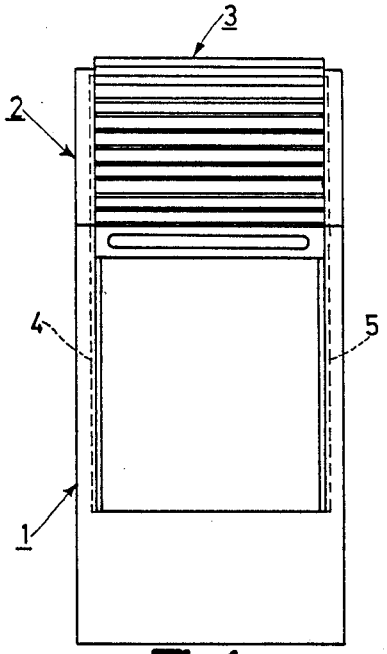
FIG. 1 shows a dry-shaving apparatus comprising a basic apparatus on which a shaving-head frame is placed, which frame holds a shear foil means of its cross-members, the shaving-head frame and shear foil being covered completely by the shutter.
Figure 2:
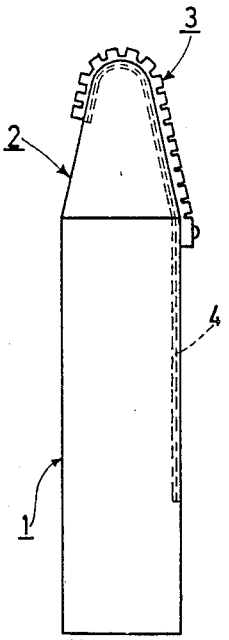
FIG. 2 is a side view of the dry-shaving apparatus shown in FIG. 1.

FIGS. 1 and 2 show a dry-shaving apparatus comprising a basic apparatus 1 and a shaving-head frame 2 placed on this basic apparatus. In a manner not shown, for example by means of at least one resilient latch the shaving-head frame 2 is detachably secured to the basic apparatus 1. Such a shaving-head frame serves for mounting an arcuate shear foil which in FIGS. 1 and 2 is covered completely by a shutter 3 to protect the shear foil when the dry-shaving apparatus is not in use. Such a shutter 3 is arranged to be slidable on the dry-shaving apparatus, said shutter being guided laterally at both sides in groove-shaped guides 4 and 5, indicated in broken lines in FIGS. 1 and 2. As can be seen, the shutter 3 can be slid from the basic apparatus 1 onto the shaving-head frame 2 and the shear foil, for which purpose the guides 4 and 5 for the shutter extend from the basic apparatus 1 into the shaving-head frame 2, where they are curved in conformity with the curvature of the shear foil. If the dry-shaving apparatus is to be used, the shutter is slid back out of its position shown in FIGS. 1 and 2 onto the basic apparatus 1 until it exposes the shear foil to enable shaving, as is shown in FIG. 3, where the shutter is slid back so far that the shaving-head frame is also exposed, enabling said frame to be removed, for example for cleaning purposes or for replacing the shear foil 7 which is mounted by means of the cross-members 6 of the shaving-head frame 2.

Figure 4:
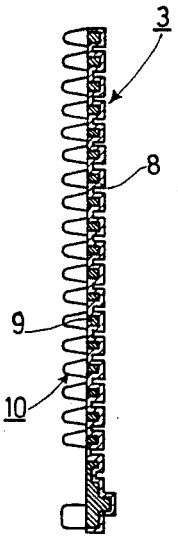
FIG. 4 shows in sectional view and in side view a shutter used in the dry-shaving apparatus of FIG. 1.

Such a shutter 3 must have a satisfactory stability in the transverse direction, to provide an effective protection for the shear foil, and a satisfactory flexibility in the longitudinal direction, to enable it to adapt itself to the shape of a shear foil, which also has a comparatively sharp curvature. To this end the shutter 3, as can be seen in FIG. 4, comprises an elastic carrier 8 and spaced slots 9 which are connected to the carrier. In order to ensure a reliable connection between the slats 9 and the carrier 8 the slats 9 in the present case are successively enveloped by the carrier 8 in a meandering pattern. The slats 9 are inherently stiff and extend across the full width of the shutter. At their ends the slats 9 comprise projections 10 which engage in guides 4 and 5 on the dry-shaving apparatus, thus laterally guiding the shutter at both sides. In the present case these projections 10, as can be seen in FIG. 5, are L-shaped and project from the slats 9 transversely of the shutter 3.

Figure 3:
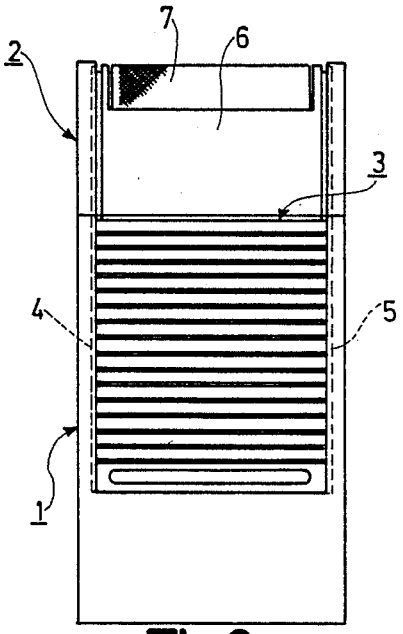
FIG. 3 shows the dry-shaving apparatus of FIG. 1, the shutter being in a position in which it exposes the shaving-head frame and the shear foil.

In such a dry-shaving apparatus care must be taken that the shaving-head frame 2 can be removed from the basic apparatus 1 only if the shutter 3 is in a position on the basic apparatus 1 in which it completely exposes the shaving-head frame and the shear foil, as is shown in FIG. 3. This prevents the shutter, the shaving-head frame or the shear foil from being damaged if it should be attempted to remove the shaving-head frame 2 from the basic apparatus 1 when the shutter 3 is not in the position in which it exposes the shaving-head frame and the shear foil. The best way to ensure this is that, depending on its position, the shutter directly inhibits removal of the shaving-head frame from the basic apparatus when the shutter is not in the position in which it exposes the shaving-head frame and the shear foil. This can be achieved in various ways, which will be described in more detail for the following embodiments.

Figure 5:
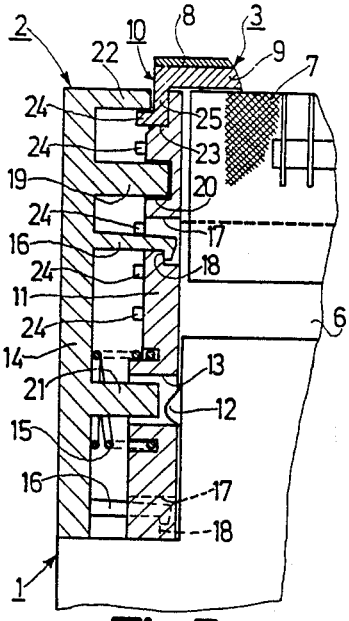
FIG. 5 is a partly sectional view of a part of a dry-shaving apparatus in which the shaving-head frame is secured to the basic apparatus by means of a resilient latch at the inner side wall of said frame and the latch is movable by an actuating element constituted by an outer side wall of the shaving-head frame, the lateral guide means for the shutter being constituted by inner side wall and the outer side wall of the shaving-head frame and the shutter directly preventing the actuating element from being actuated to move the latch.

In the embodiment shown in FIG. 5 the shaving-head frame 2 is secured by at least one of its side walls 11 with the aid of a resilient latch 12 which is arranged on a side wall of the basic apparatus 1 and engages in an opening 13 in the side wall 11 of the shaving-head frame 1. In order to detach the shaving-head frame from the basic apparatus, the latch 12 is movable by an actuating element arranged on the side wall 11 of the shaving-head frame until it disengages from the opening 13 in the side wall 11 of the shaving-head frame, enabling the shaving-head frame to be removed from the basic apparatus 1. In the present case this actuating element for moving the latch in order to detach the shaving-head frame from the basic apparatus is constituted by an additional side wall 14 which extends parallel to and is situated at the outer side of the side wall 11 of the shaving-head frame. This additional outer side wall 14 is arranged on the inner side wall 11 so as to be movable towards the latch 12 against the action of the spring 15, for which purpose three hooks 16 are arranged on the side wall 14, of which one hook is visible completely in FIG. 5 and another offset hook is visible partly. Each of these hooks 16 engages in an opening 17 formed in the inner side wall 11, abutting against a projection 18 which is arranged on the inner side wall 11 and engages in this opening 17, thus limiting the range of movement of the outer side wall 14 in the direction of the latch 12. In the present case the outer side wall 14 is pivotable on the inner side wall 11, its pivotal axis extending in the area of the shaving-head frame which is remote from the basic apparatus. This is achieved in that at a location which is remote from the basic apparatus the outer side wall 14 carries a projection 19 which extends towards the inner side wall 11 and which engages in a recess 20 in the inner side wall 11 in which it abuts to form a pivotal axis which only allows the portion of the outer side wall 14 facing the basic apparatus 1 to be pivoted towards the inner side wall. Opposite the latch 12 the outer side wall 14 carries a further projection 21 which engages in the opening 13 in the inner side wall 11 and thus faces the free end of the latch 12. When the outer wall 14 is pivoted its projection 21 cooperates with the latch 12, causing this latch to be moved so far that it enables the shaving-head frame to be removed from the basic apparatus.

In the present embodiment the lateral guide 4 for the shutter 3 continues from the basic apparatus 1 into the shaving-head frame 2, where it is constituted by the two side walls 11 and 14 of the shaving-head frame, the shutter extending over the inner side wall 11 of the shaving-head frame. At the location of the shaving-head frame this lateral guide is constituted by a peripheral angular portion 22 situated on the outer side wall 14 and directed towards the inner side wall 11, and by a peripheral offset portion 23 situated on the inner side wall 11 and directed towards the outer side wall 14, which portions are spaced from each other, the L-shaped projections 10 on the slats 9 of the shutter 3 engaging in the gap between the angular portion 22 and the offset portion 23. In this way both the inner side wall 11 with its offset portion 23 and the outer side wall 14 with its angular portion 22 assist in guiding the shutter, because they enclose the free ends 24 of the L-shaped projections 10 on the slats 9 of the shutter. The portions 25 of the L-shaped projections 10 on the slats 9 extend between the inner side wall 11 and the free end of the angular portion 22 on the outer side wall 14, as a result of which the outer side wall 14 cannot be pivoted towards the latch 12, thereby preventing the shaving-head frame from being removed from the basic apparatus when at least a part of the shutter is situated in the area of the shaving-head frame. Thus removal is inhibited until the last projection 10 of the shutter 3 has left the guide means 4 at the location of the shaving-head frame, which is the case when the shutter completely exposes the shaving-head frame 2 and the shear foil 7. This blocking action, which is sustained until the last projection of the shutter 3 has left the guide 4 at the location of the shaving-head frame is also promoted by the fact that the outer side wall 14 of the shaving-head frame, which wall constitutes the actuating element for moving the latch 12, can be pivoted by hand towards the latch 12 only at the location where it faces the basic apparatus 1, i.e. in the area where the shutter ultimately leaves the guide means in the area of the shaving-head frame. This ensures in a very reliable manner that the shaving-head frame can be removed from the basic apparatus only when it is exposed completely by the shutter.

Figure 6:
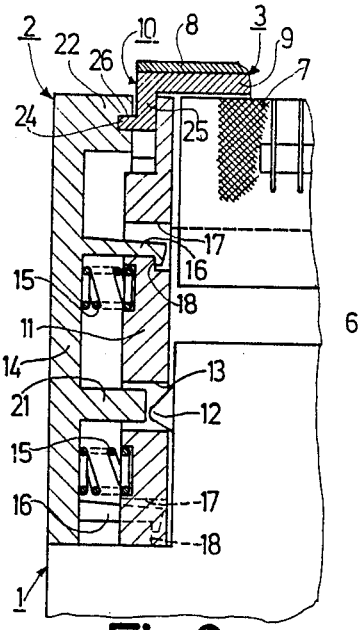
FIG. 6 in the same way shows the embodiment of FIG. 5, but modified with respect to the construction of the actuating element for the latch and the lateral guide means for the shutter.

In the embodiment shown in FIG. 6 the outer side wall 14 constituting the actuating element for the latch 12 is arranged on the inner side wall 11 of the shaving-head frame so as to be slidable towards this side wall 11, this construction again comprising three hooks 16 in a way similar to the embodiment shown in FIG. 5. The shutter 3 is again laterally guided by means of L-shaped projections 10 on the slats 9. At the location of the shaving-head frame, however, guiding is not effected by means of both the inner side wall 11 and the outer side wall 14, but by the outer side wall 14 only. For this purpose the free end of the peripheral angular portion 22 which is situated on the outer side wall 14 and which is directed towards the inner side wall 11 is formed with a groove-shaped recess 26 in which the free ends 24 of the L-shaped projections 10 engage. The portions 25 of the L-shaped projections 10 on the slats 9 of the shutter 3 then extend in the gap between the inner side wall 11 and the free end of the angular portion 22 on the outer side wall 14, so that together with the free ends 24 they prevent the actuating element constituted by the outer side wall 14 from being actuated to move the latch 12, again until the projections 10 of the shutter 3 have left the guide in the area of the shaving-head frame and the shaving-head frame is exposed completely by the shutter.

Figure 7:
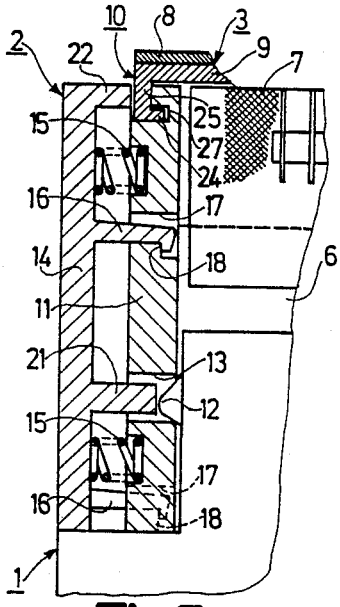
FIG. 7 in the same way shows the embodiment of FIG. 6, modified with respect to the lateral guide means for the shutter.

The embodiment shown in FIG. 7 differs from the embodiment shown in FIG. 6 in that the L-shaped projections 10 on the slats 9 of the shutter 3 have free ends 24 directed towards the shutter center. Therefore, the inner side wall 11 of the shaving-head frame is formed with a guide groove 27 in which the free ends 24 of the projections 10 engage. Again the portions 25 of the projections 10 on the slats 9 of the shutter 3 extend in a gap between the inner side wall 11 and the free end of the angular portion 22 on the outer side wall 14, thereby again preventing the actuating element constituted by the outer side wall 14 from being actuated to move the latch 12 until the shutter 3 has fully exposed the shaving-head frame 2.

Figure 8:
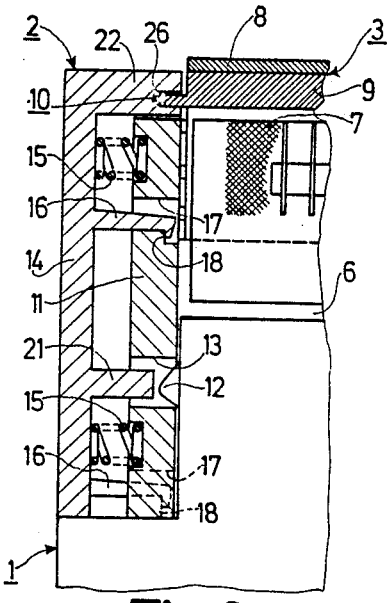
FIG. 8 in the same way shows the embodiment of FIG. 6, modified with respect to the lateral guide means for the shutter.

In the embodiment shown in FIG. 8 the projections 10 on the slats 9 of the shutter 3 comprise pins which project laterally from the slats. For the lateral guidance of the shutter these projections 10, in the same way as in the embodiment in FIG. 6, engage in a guide groove 26 formed in the free end of the angular portion 22 on the outer side wall 14 which constitutes the actuating element for the latch 12. In the present case the angular portion 22 on the outer side wall 14 engages peripherally around the inner side wall of the shaving-head frame. In this way the slats 9 and projections 10 of the shutter inhibit a movement of the outer side wall 14 towards the latch 12 until the shutter has left the guide means in the area of the shaving-head frame and the shutter has thus completely exposed the shaving-head frame.

Figure 9:
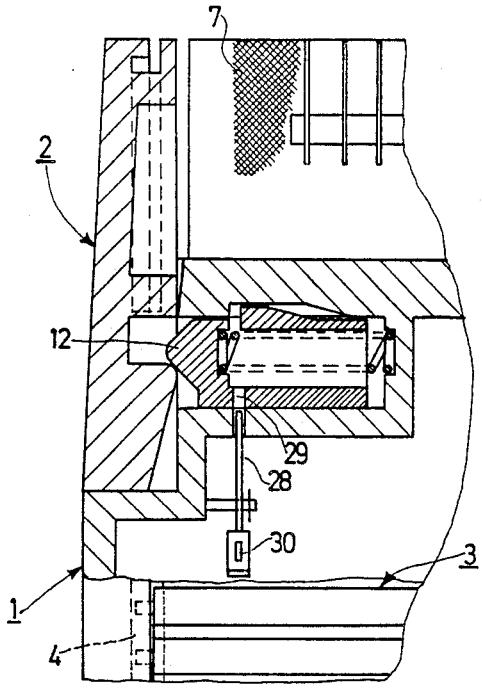
FIG. 9, in the same way as FIG. 5, shows an embodiment in which the shutter directly inhibits a movement of the latch securing the shaving-head frame to the basic apparatus.

The embodiment shown in FIG. 9 concerns a dry-shaving apparatus in which the shaving-head frame 2 is again secured to the basic apparatus 1 by means of at least one resilient latch 12, but which for detaching the shaving-head frame from the basic apparatus does not comprise an actuating element for the latch, the shaving-head frame being simply pulled off the basic apparatus by hand and the latch 12 being moved by means of the shaving-head frame 2. In such a case it is found to be advantageous if the movement of the latch 12 when the shaving-head frame is detached from the basic apparatus is inhibited directly by the shutter 3 until the shutter has completely exposed the shaving-head frmae. For this purpose the basic apparatus is now provided with a pivotable blocking lever 28 which during its pivotal movement engages in a recess 29 in the latch 12, to prevent the latch from being moved. This blocking lever 28 cooperates with a sensor 30 which projects in the path of the shutter when the shutter is moved out of its position in which it exposes the shaving-head frame and the shear foil. As can be seen, this sensor 30 is activated directly when the shutter 3 moves out of its clearing position, so that the blocking lever 28 blocks the latch 12, as a result of which the shaving-head frame 2 can no longer be removed from the basic apparatus because movement of the latch 12 is blocked.

Figure 10:
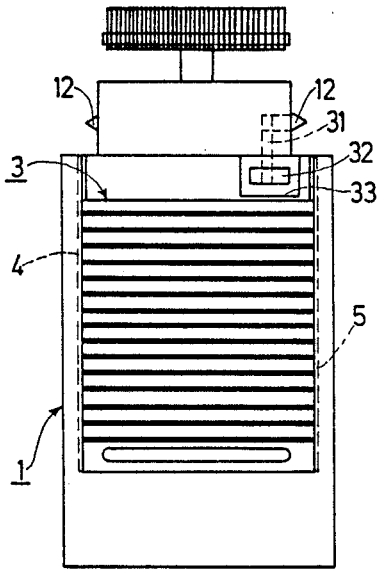
FIG. 10 shows the basic apparatus of a dry-shaving apparatus, in which the latch for securing a shaving-head frame to the basic apparatus is movable by an actuating element on the basic apparatus, actuation of the actuating element being inhibited by the shutter.
Figure 11:
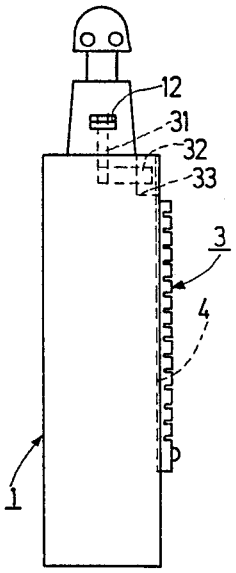
FIG. 11 is a side view of the basic apparatus as shown in FIG. 10.

FIGS. 10 and 11 show a basic apparatus of a dry-shaver from which the shaving-head frame has been removed. Two resilient latches 12 arranged on side walls of the basic apparatus serve for securing the shaving-head frame to the basic apparatus. One of these latches 12 comprises a projection 31 which extends into the area of an actuating element in the form of a push-button 32 for moving the latch 12, which button is arranged in a recess 33 in the housing of the basic apparatus. This push-button 32 cooperates with the projection 31 via inclined surfaces, so that when the push-button 32 is depressed the latch 12 is moved into the basic apparatus, after which a shaving-head frame placed on the basic apparatus can be removed. The shutter 3, which is slidable on the basic apparatus 1, can be slid out of its position shown in FIGS. 10 and 11, in which it exposes the shaving-head frame and the shear foil, over the recess 33 onto the shaving-head frame on the basic apparatus to cover the shear foil mounted in the shaving-head frame. As can be seen, the push-button 31 cannot be activated in such a position of the shutter 3, because the recess 33 is covered by the shutter 3. In this way the actuating element for the latch 12 then cannot be actuated to detach the shaving-head frame from the basic apparatus. Thus, the shaving-head frame can be removed from the basic apparatus only if the shutter 3 is in its position in which it exposes the shaving-head frame and shear foil.

As is apparent from the foregoing, there are several possibilities within the scope of the invention to ensure that the shaving-head frame can be removed from the basic apparatus only when a shutter for the projection of a shear foil is in a position in which it exposes the shaving-head frame and the shear foil. Obviously, further modifications of the embodiments described above are possible within the scope of the invention.

What is claimed is:

1. A dry-shaving apparatus comprising at least one slidable shutter for optionally covering or exposing a shear foil of the dry-shaving apparatus, a shaving-head frame which carries the shear foil and which is detachably secured to a basic apparatus by means of at least one resilient latch wherein the shutter is slidable from a position on the basic apparatus in which it exposes the shaving-head frame and the shear foil to a position in which it covers the shaving-head frame and the shear foil, and wherein the shutter prevents the latch from being moved for detachment of the shaving-head frame from the basic apparatus when said shutter is slid at least partly out of its position in which the shaving-head frame and shear foil are exposed.

2. A dry-shaving apparatus as claimed in claim 1, wherein for detaching the shaving-head frame from the basic apparatus the latch is movable by means of an actuating element and, the shutter, when slid at least partly out of the position in which it exposes the shaving-head frame and the shear foil, prevents the actuating element from being actuated in order to move the latch for detaching the shaving-head frame from the basic apparatus.

3. A dry-shaving apparatus as claimed in claim 2, comprising a shutter which has an elastic carrier and spaced-apart slats and which is guided laterally at both sides in groove-shaped guides on the dry-shaving apparatus, wherein:

a resilient latch arranged on a side wall of the basic apparatus secures the shaving-head frame by at least one of its two side walls and for detaching the shaving-head frame from the basic apparatus the latch is movable by an actuating element provided on the side wall of the shaving-head frame;

the actuating element for moving the latch to detach the shaving-head frame from the basic apparatus is constructed as an additional side wall of the shaving-head frame, which additional side wall extends parallel to and is situated at the outer side of the side wall of the shaving-head frame;

the lateral guide means for the shutter in the basic apparatus is continued at the location of the shaving-head frame in at least one of the two parallel side walls of the shaving-head frame;

the shutter extends over the inner side wall of the shaving-head frame; and the ends of the slats, which slats extend across the full width of the shutter, are provided with stiff lateral projections which engage in said guide means.

4. A dry-shaving apparatus as claimed in claim 3, wherein the slats are inherently stiff and have L-shaped projections that project from the slats transversely of the shutter, the portions which project transversely from the slats extending in a gap formed at the location of the shaving-head frame between the inner side wall and the outer side wall and engaging in the guide means with their free ends.

5. A dry-shaving apparatus as claimed in claim 4, wherein at the location of the shaving-head frame the lateral guide means for the shutter is constituted by a peripheral angular portion situated on the outer side wall and directed towards the inner side wall, and a peripheral offset portion situated on the inner side wall and directed towards the outer side wall, which portions are spaced from each other, the free ends of the L-shaped projections of the slats of the shutter engaging in a gap between the angular portion and the offset portion.

6. A dry-shaving apparatus as claimed in claim 5 wherein the outer side wall constituting the actuating element for moving the latch is pivotably arranged on the inner side wall of the shaving-head frame, the pivotal axis being situated in the area of the shaving-head frame which is remote from the basic apparatus.

* * * * *